US005187527A

United States Patent [19]

Forlani et al.

[11] Patent Number: 5,187,527

[45] Date of Patent: Feb. 16, 1993

[54] DEVICE FOR ELIMINATING THE CURL OF SHEETS EMERGING FROM A FIXING STATION

[75] Inventors: Riccardo Forlani; Michele Olivero, both of Turin, Italy

[73] Assignee: Olivetti-Canon Industriale S.p.A., Ivrea, Italy

[21] Appl. No.: 788,357

[22] Filed: Nov. 6, 1991

[30] Foreign Application Priority Data

Nov. 6, 1990 [IT] Italy ..... 67866A

[51] Int. Cl.[5] ..... G03G 15/20

[52] U.S. Cl. ..... 355/282; 162/271; 355/285

[58] Field of Search ..... 355/282, 285, 290, 295, 355/308, 309; 219/216; 162/270, 271; 271/161, 188, 209

[56] References Cited

U.S. PATENT DOCUMENTS 4,652,110 3/1987 Sato et al. ..... 219/216 X
4,933,726 6/1990 Moriyama ..... 355/290 X

FOREIGN PATENT DOCUMENTS 0083978 5/1985 Japan ..... 355/282
0239274 10/1986 Japan ..... 355/282
0147765 6/1988 Japan ..... 271/161
0276077 11/1988 Japan ..... 355/285

*Primary Examiner*—A. T. Grimley
*Assistant Examiner*—William J. Royer
*Attorney, Agent, or Firm*—Banner, Birch, McKie & Beckett

[57] ABSTRACT

An image is fixed to a sheet of paper, in an image reproducing machine in a fixing station (GF). This uses heat and pressure to fix the image. A pair of straightening rolls (24, 26) downstream of the fixing station apply tension to the sheets in the direction of advance and forward them in a direction which inclines by a predetermined angle of correction with respect to the direction (21) with which the sheets leave the fixing station. The straightening rolls form a nip (62) therebetween and this may extend around a portion of the periphery of one of the rolls such that sheets passing therethrough are bent in an opposite direction to their natural direction of curl.

6 Claims, 3 Drawing Sheets

DEVICE FOR ELIMINATING THE CURL OF SHEETS EMERGING FROM A FIXING STATION

BACKGROUND OF THE INVENTION

The present invention relates to a device for eliminating sheet curl and more particularly for eliminating sheet curl from sheets emerging from a hot fixing station in a copying machine or any similar image processing machine.

It is well known, that in an electrophotographic copier the images to be reproduced are developed by means of particles of toner and are then transferred to a sheet of paper.

In order to fix the particles of toner to the paper, the sheets are passed through a fixing station, which works by heat and pressure, in which the particles of toner are softened and caused to penetrate into the paper, thereby fixing them stably to the paper.

As a result of the effect of the heat and pressure, tensions are created within the thickness of the paper and the sheets of paper tend to curl. Subsequently, when deposited in a delivery tray, the sheets may retain this curl and in some cases a sheet may roll up on itself.

Devices which attempt to overcome this problem are known which use stationary guides orientated in such a way as to bend the sheet in the opposite direction to that which it wishes naturally to adopt by curling. However, these devices fail to eliminate sheet curl altogether, and in fact with certain kinds of paper they can induce a curl in the opposite direction.

SUMMARY OF THE INVENTION

A device for eliminating sheet curl is placed downstream of a fixing station in a photocopier, laser printer or the like. The device is formed from a pair of rolls which receive the sheets therebetween and apply tension to them in the direction of advance. The rolls forward the sheets in a direction out of line with the direction with which they leave the fixing station. Using such an arrangement sheet curl is eliminated and sheets are made perfectly flat.

A pair of straightening rolls may be provided which define a nip which extends around one of the rolls. Sheets pass through this nip and are bent in an opposite direction to the natural direction of curl which they have on leaving the fixing station.

The invention is defined in its various aspects in the appended claims to which reference should now be made.

DETAILED DESCRIPTION OF PREFERRED EMBODIMENTS

Embodiments of the invention will now be described in detail by way of example with reference to the accompanying drawings in which.

Figure 1:
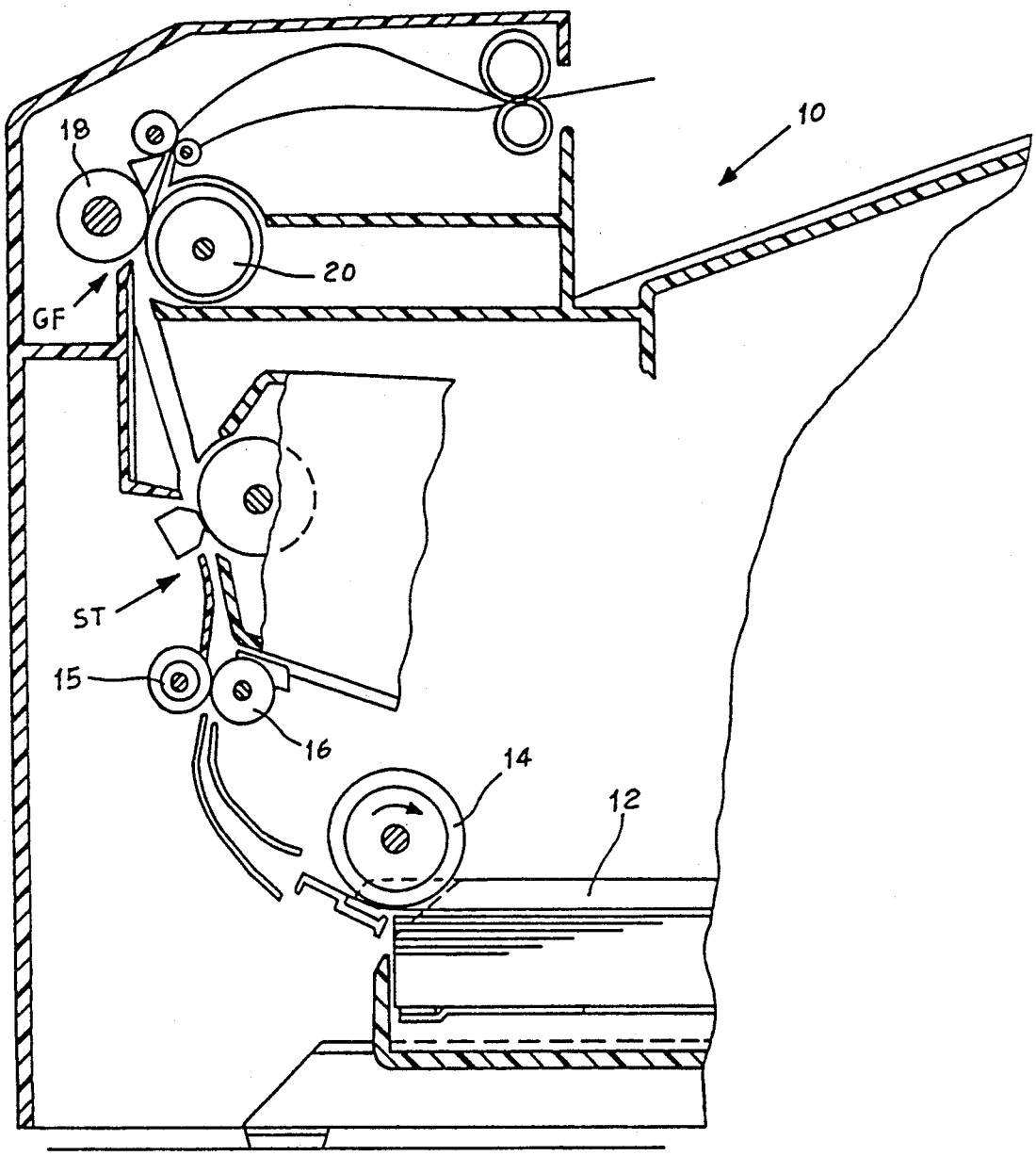
FIG. 1 is a partial view of a copier using the device for eliminating sheet curl according to the invention.

With reference to FIG. 1, the device for eliminating sheet curl according to the invention is inserted, for example, into an electrophotographic copier 10, shown only partly in FIG. 1 for the sake of simplicity.

The sheets are held in a cassette 12 from which they are taken one at a time by means of a friction roll 14, and are passed to a developing and transfer station ST, by means of a pair of forwarding rolls 15, 16. At the station ST an image formed by particles of toner is transferred to a sheet which is then forwarded to a fixing unit GF. The unit GF is composed of two rotating rolls 18, 20 between which the sheet is passed. The roll 20 engages the sheet on the face carrying the toner image and it is covered with a layer of toner repellent material, for example TEFLON TM and heated to a temperature of about 180° C. to soften the particles of toner.

The roll 18, opposite the roll 20, acts on the back of the sheet and is covered with a soft rubber layer and is pressed against the roll 20 with sufficient force to form an approximately 4 mm-wide nip between the two rolls.

When the sheet, carrying the toner image on the face nearest the hot roll 20, is passed between the two rolls 18, 20 (FIG. 2), the combined action of the pressure and the heat causes the toner particles to soften and penetrate between the fibres of the sheet, so causing the image to adhere permanently to the sheet.

However, the effect of the heat and pressure combined together generates tensions within the thickness of the sheet, causing the sheet to curl. Consequently, on emerging from the fixing rolls, the unguided sheet would take a natural leaving direction 21 inclining towards the hot roll 20, with respect to the common tangent T of the two rolls 18, 20 and would tend to bend as indicated by a broken line 22.

To overcome this problem, the sheet emerging from the fixing rolls 18, 20 is passed through two rolls 24, 26 arranged downstream of the rolls 18, 20 at a certain distance D.

Figure 2:
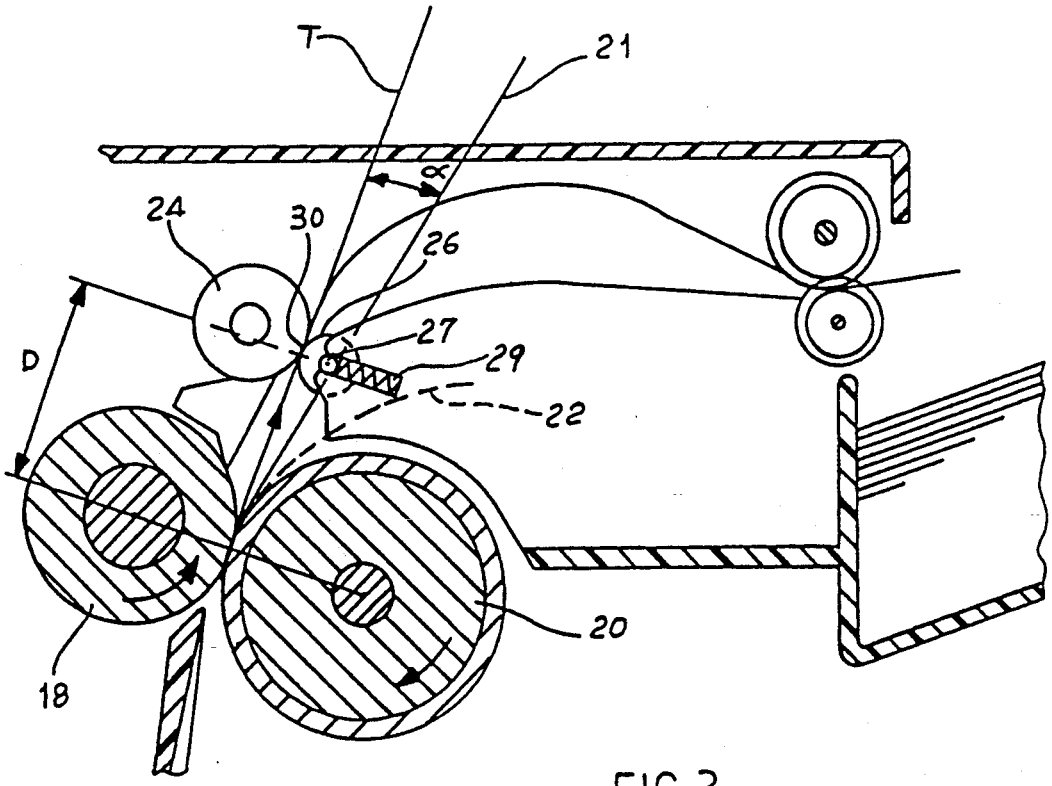
FIG. 2 is a view on an enlarged scale of the device of FIG. 1.

The roll 24 is of rubber with a Shore hardness of approximately 60 and is rotated anticlockwise in FIG. 2 by means of a kinematic transmission, not shown in the drawings, connected to the fixing roll 20 and to a main motor of the copier, also not shown for simplicity in the drawings.

The roll 26 turns idly on a pin 27 and is pressed against the roll 24 by means of a spring 29 with a force which is typically of between 90 and 100 g.

The roll 26 is covered with toner-repellent substance, for example TEFLON TM, to avoid sticking of the particles of toner of the images fixed on the sheet.

The rolls 24 and 26 are arranged in such a manner that their nip 30 will lie in the half-plane limited by the common tangent T of the rolls 18, 20, on the further side with respect to the hot roll 20 and at a distance of not more than 2 mm from the tangent T. Preferably the nip 30 lies on the tangent T.

The arrangement makes it possible for the sheet to emerge from the fusing rolls in a direction inclining towards the roll 18 by-an angle-of not less than 5° with respect to the natural direction of emergence 21 of the sheet.

The operation of bending the sheet in the opposite direction to the natural curling adopted by the sheet as it emerges from the fixing rolls, is combined with a tension in the direction of advance.

To this end the roll 24 is rotated with a peripheral speed V' 5–10% greater than the peripheral speed V of the roll 20. This creates a sliding of the roll 24 over the back of the sheet, from the front edge, until the rear edge leaves the nip of the rolls 18, 20.

The operation of eliminating the curl is effective if applied to the sheet while the latter is still hot enough, or in other words within a characteristic predetermined time Tr of cooling of the sheet after it has left the hot roll 20.

The cooling time Tr is the time in which the sheet emerging from the fixing rolls cools from the fixing temperature of around 140° C. to a minimum temperature beneath which the combined action of straightening and tensioning applied by the rolls 24, 26 is no longer effective. This minimum temperature will vary between 60° C. and 100° C. For the types of paper normally used in electrophotographic copiers and in printers using a toner transfer process, this minimum temperature is preferably 75° C.

This condition will be satisfied by arranging the rolls 24 and 26 a distance D from the rolls 18 and 20 calculated by the relation: $D \leqq V.Tr$, in which V is the peripheral speed of the hot roll 20. For the most commonly used types of paper and in normal conditions of ventilation of the machine, the time Tr is between 0.5 and 1.1 s, where the paper advances between the fixing rolls at a speed of between 35 mm/s and 60 mm/s. However, it is preferable for the distance D to be between 35 mm and 40 mm.

Figure 3:
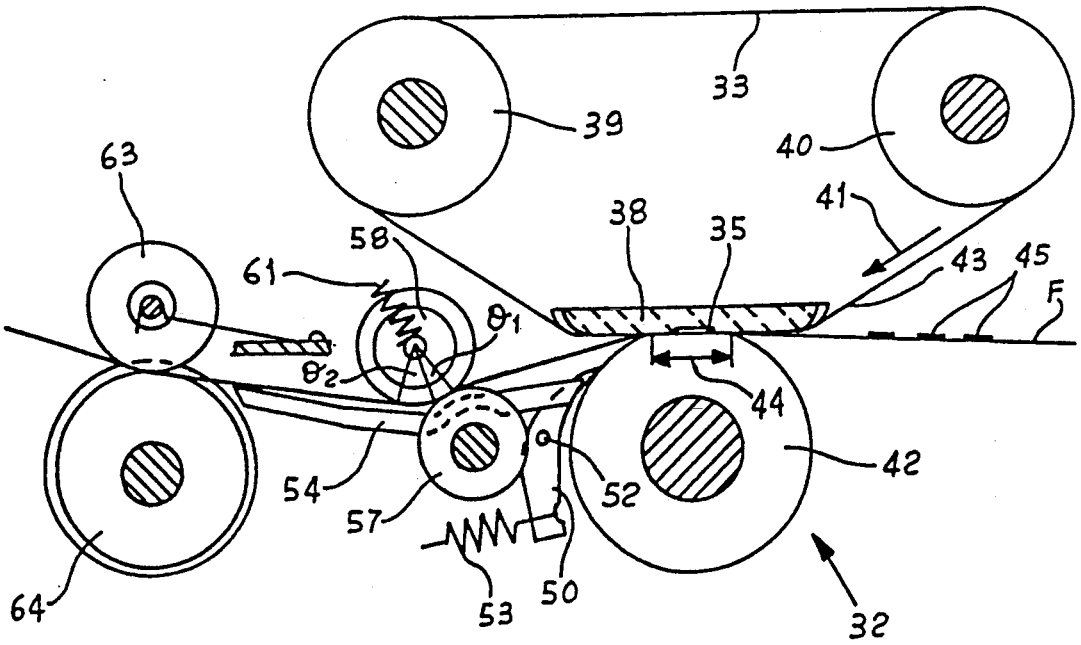
FIG. 3 is a diagrammatic representation of a second embodiment of the device for eliminating sheet curl.

FIG. 3 shows another embodiment of the device for eliminating sheet curl according to the invention, in the case in which a belt-type fixing station 32 is used.

In this known arrangement, an endless belt 33 conveys the sheets in front of a flat heating element 35 fixed to a plate 38 positioned inside the belt 33. The belt revolves around two rolls 39, 40 driven so as to move the belt in the direction of the arrow 41.

The element 35 is formed by, for example, a strip of electrically resistive material lying perpendicular to the plane of FIG. 3 over the full width of the sheet. The element 35 may be approximately 2 mm in width and is heated to approximately 230° C. by applying to its ends an electrical current of suitable strength. A counter-roll 42 of heat-resistant rubber is pressed against the outer surface 43 of the belt 33 opposite the element 35 in such a way as to form a nip 44 between the roll and the belt to a width not less than the width of the heating element 35.

Figure 4:
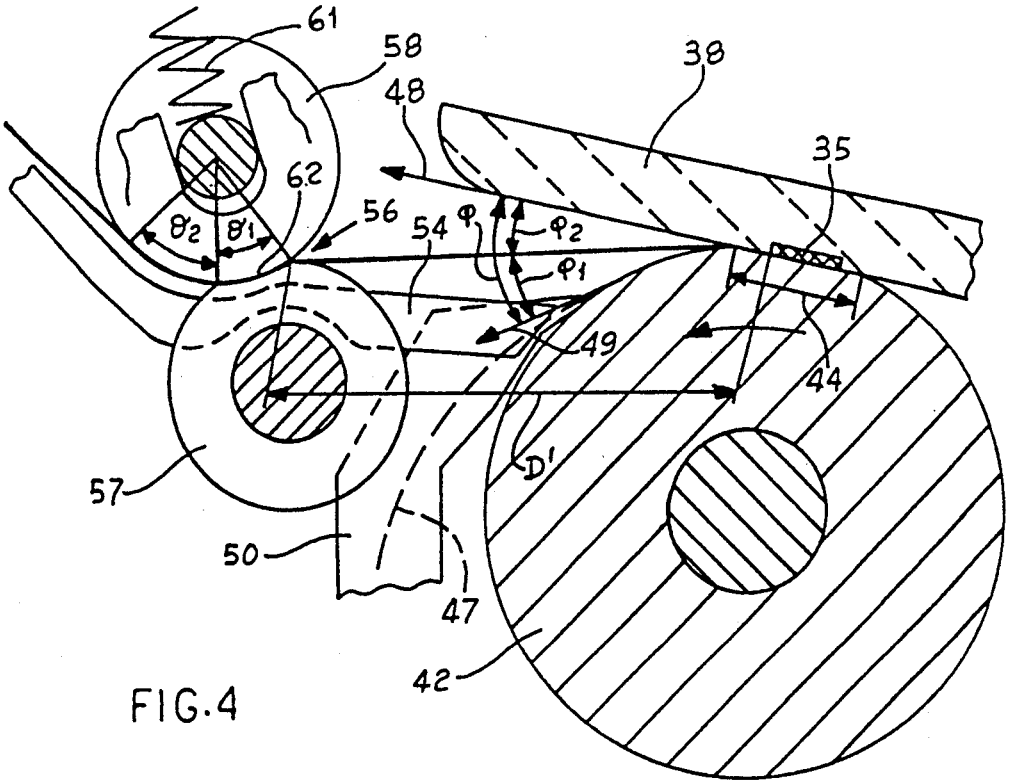
FIG. 4 shows an enlarged detail of FIG. 3.

The fixing of an image 45 of toner deposited on one face of a sheet F takes place by heating the element 35, which through the belt 33 produces the softening of the toner particles, while the pressure applied by the roll 42 causes the toner to adhere to the sheet F. Sheets emerging from the nip 44 adopt a curl 47 (FIG. 4) which is concave on the side remote from the element 35, so taking them away from the belt 33. The sheets tend to stay stuck to the roll 42 for a short distance, moving in a natural direction indicated by an arrow 49 in FIG. 4, pointing downwards. This natural direction 49 forms with the tangent 48 to the roll 42 in the nip with the belt 33 a variable angle $\phi$ of between 25° and 40° depending on the type of paper used.

To encourage the sheet to leave the roll 42 a knife element 50 is provided (FIG. 3), being hinged at the point 52 and pressed against the roll 42 by a spring 53.

A guide 54 carries the sheet to the nip 56 between two rolls 57, 58 placed downstream of the fixing station 32.

The lower roll 57 is covered with a soft rubber with a Shore hardness of between 25 and 40 and is kinematically connected in a known way not shown in the drawings to the drive roll 39.

The upper roll 58 turns idly and is covered with a layer of synthetic toner-repellent material whose Shore hardness of approximately 60–70 is greater than that of the roll 57.

The upper roll 58 is pressed elastically by a spring 61 against the roll 57 with sufficient force to deform the roll 57 so as to form a nip 62 extending along the periphery of the roll 58 over an angle $\theta_1$ of between 5° and 30° and preferably of 15°.

The shape of the nip 62 is such as to impart to the sheet a curl in the opposite direction to the natural curl 47, that is with its concavity turned towards the element 35.

The rolls 57, 58 are rotated with a peripheral speed that is some 5% greater than the speed of the belt 33, as a result of which the sheet emerging from the fixing station is kept taut by the rolls 57, 58 in the direction of advance.

The rolls 57 and 58 must be positioned as close as possible to the fixing station 32, so that the temperature of the sheet does not drop below the limit temperature, indicated above. It has been found that the distance D' between the nip 62 and the nip 44 between the roll 42 and the belt 33 should be not greater than 40 mm and preferably between 25 and 30 mm.

The rolls 57, 58 are furthermore positioned in such a way that the sheet is kept taut between the nips 44 and 62 in a direction forming with the natural direction 49 an angle $\phi_1$ of betweeen 5° and 20° and forming with the tangent 48 an angle $\phi_2$ of not less than 10°.

Downstream of the rolls 57, 58 is another pair of rolls 63, 64 positioned in such a way as to make the sheet adhere to the roll 58 over a further arc $\theta_2$ following the nip 62, of between 10° and 45° and preferably of 30°.

The roll 63 is connected kinematically in a known manner to the roll 57, while the roll 64 turns idly and is pressed elastically against the roll 63. The roll 63 is rotated with a peripheral speed which is some 4% greater than the peripheral speed of the rolls 57, 58, in order to apply to the sheet a tension that will ensure that the sheet is wrapped around the roll 57 along the arc $\theta_2$.

Figure 5:
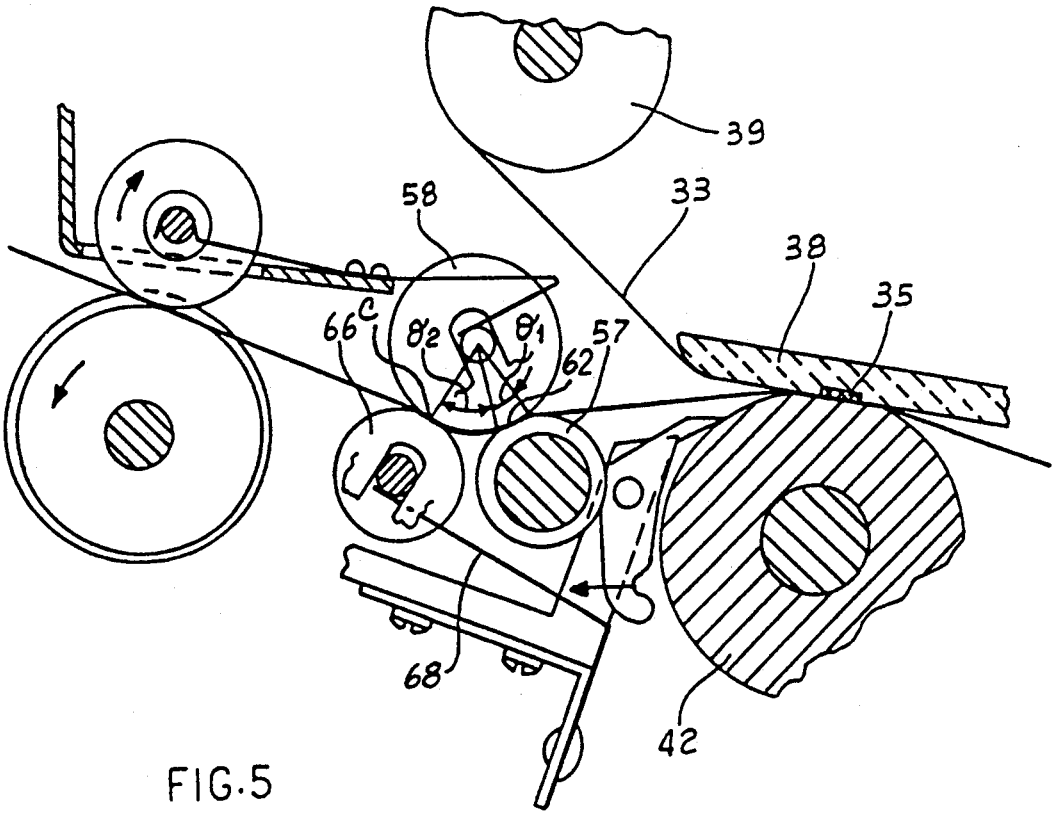
FIG. 5 shows another embodiment of the device of FIG. 3.

FIG. 5 shows a variant of the device of FIG. 3.

For the sake of simplicity, in FIG. 5 the same reference numerals are kept for parts also appearing in FIG. 3.

In FIG. 5 the guide 54 has been omitted, and an extra roll 66 is arranged against the roll 57 after the roll 58 in the direction of movement of the sheet. The roll 66 is pressed against the roll 58 by means of a spring 68 at a nip point C angularly distant by the angle $\theta_2$ of FIG. 4 from the nip 62 between the rolls 57, 58.

The purpose of a roll 66 is to ensure that there is contact between the sheet and the roll 57 along the arc $\theta_2$.

It will be understood that changes, additions or substitutions of parts may be made to the device for eliminating sheet curl, without thereby departing from the scope of the invention.

We claim:

1. A device for eliminating the curl of sheets emerging from a fixing station of an image reproducing machine, comprising:

a fixing station for fixing images to sheets by pressure and heat, said sheets having a natural leaving direction from the fixing station;

a pair of straightening rolls installed downstream of said fixing station in order to apply a tension to said sheets and to forward them in a direction of advance out of line with said natural direction by an angle of correction of not less than 5°, wherein said straightening rolls are arranged away from said fixing station by a distance D given by the relation: $D \leqq V.Tr$, Tr being the characteristic time of cooling of a sheet emerging from the fixing station at speed V.

2. A device according to claim 1, wherein said fixing station comprises a flat heating element, and said straightening rolls form a first nip between 5° and 30° wide, measured on the periphery on a first one of said rolls.

3. A device according to claim 2, wherein said first nip is preferably 15° wide.

4. A device according to claim 2, wherein said sheets wrap around said first roll over a second area of contact of between 10° and 45° adjacent to said first nip.

5. A device according to claim 4, comprising a pair of drawing rolls arranged downstream of said straightening rolls in such a way as to hold said sheets adhering to said second area of contact.

6. A device according to claim 5, wherein an extra straightening roll is provided tangential to said first straightening roll at a point that is out of line with said direction of rotation of said first roll, said extra roll delimiting said second area of contact.

* * * * *